United States Patent [19]

Lang

[11] 4,440,103

[45] Apr. 3, 1984

[54] SEMI-SUBMERGED SHIP CONSTRUCTION

[76] Inventor: Thomas G. Lang, 417 Loma Larga Dr., Solana Beach, Calif. 92075

[21] Appl. No.: 293,083

[22] Filed: Aug. 14, 1981

Related U.S. Application Data

[63] Continuation of Ser. No. 73,183, Sep. 7, 1979, abandoned.

[51] Int. Cl.[3] ..... B63B 25/00

[52] U.S. Cl. ..... 114/61; 114/72; 114/125

[58] Field of Search ..... 114/56, 61, 72, 73, 114/74 R, 74 A, 125, 264, 265, 267, 256, 257

[56] References Cited

U.S. PATENT DOCUMENTS

| | | | |
|---|---|---|---|
| 1,757,174 | 5/1930 | Douglas | 114/61 |
| 2,988,035 | 6/1961 | Gram | 114/123 X |
| 3,160,135 | 12/1964 | De Vries | 114/123 |
| 3,376,841 | 4/1968 | Gill | 114/267 X |
| 3,397,545 | 8/1968 | Leavitt | 114/265 X |
| 3,623,444 | 11/1971 | Lang | 114/61 |
| 3,704,678 | 12/1972 | Kelly | 114/257 X |
| 3,834,174 | 9/1974 | Strumbos | 114/74 A |
| 3,848,559 | 11/1974 | Tarossi | 114/74 A |
| 3,960,100 | 6/1976 | Chapman | 114/61 |
| 4,091,760 | 5/1978 | Lloyd | 114/265 X |

FOREIGN PATENT DOCUMENTS

| | | | |
|---|---|---|---|
| 628780 | 6/1934 | Fed. Rep. of Germany | 114/125 |

*Primary Examiner*—Sherman D. Basinger
*Attorney, Agent, or Firm*—Brown & Martin

[57] ABSTRACT

A semi-submerged ship having a superstructure supported on struts above a pair of submerged buoyant hulls, the structure being arranged in such a manner that cargo can be stored in or passed through the struts and submerged hulls. Internal structure is minimized by using double walled load bearing construction, with easy access through the struts between the superstructure and the submerged hulls. The arrangement is adaptable to solid or liquid cargo, with provision for circulating liquid and for thermal control when required. The structure can be applied to a wide range of design configurations to suit various size, performance, function and payload requirements.

24 Claims, 18 Drawing Figures

SEMI-SUBMERGED SHIP CONSTRUCTION

This is a continuation of application Ser. No. 73,183 filed Sept. 7, 1974, and now abandoned.

BACKGROUND OF THE INVENTION

Semi-submerged vessels have been proposed or constructed in various configurations, several examples being shown and described in U.S. Pat. No. 3,623,444. In most of these vessels there is considerable internal structure which limits the use of the available space. The submerged hulls, for example, are usually limited to use as fuel tanks or for controllable water ballast systems. The superstructure above water can be arranged in any suitable manner and is readily accessible, but access to the submerged hulls is through the supporting struts, which are restricted by structural requirements.

Use of the struts for storage and for easy access to the hulls would greatly increase the useful space in the vessel, and would also allow the effective center of mass to be lowered for improved stability.

SUMMARY OF THE INVENTION

The semi-submerged ship construction described herein utilizes double walled load bearing structure with a minimum of internal obstructions. The double walled structure is used primarily in the struts, since these are usually the most restricted portions of the vessel, but is also applicable to other parts of the vessel.

Various wall structures can be used, with inner and outer walls joined by spaced stiffeners, or the space filled with foam, honeycomb, or other such filler material, combined with stiffeners if required. When a foam filler is used, this can act as thermal insulation, so that the cargo can be cooled or heated by thermal control elements in the wall structure.

The useful space can be continuous through the struts and hulls and even include portions of the superstructure in a closed path through which cargo can be circulated. Solid or packaged cargo can be handled on suitable conveyor type equipment, while liquids can be simply pumped through the system. This facilitates loading and unloading, but the circulation can also be used to treat water when carrying live cargo, such as fish or other marine creatures.

The double wall structure can be integrated with the submerged hulls or parts of the hulls for simplicity and strength and to provide continuity of the useful space. By eliminating much internal structure and concentrating the strength in the walls, the structural weight can be reduced and a large amount of internal space made available, without compromising the hydrodynamic form and low drag lines of the vessel.

The primary object of this invention, therefore, is to provide a new and improved semi-submerged ship structure.

Another object of this invention is to provide a semi-submerged ship with a superstructure supported on struts above submerged hulls, in which internal structure is minimized to increase the useful internal space.

Another object of this invention is to provide a semi-submerged ship in which major portions of the struts and other components have double walled hollow shell construction.

A further object of this invention is to provide a semi-submerged ship which is adaptable to a wide variety of cargo and utilization requirements.

Other objects and advantages will be apparent in the following detailed description, taken in conjunction with the accompanying drawings, in which.

DESCRIPTION OF THE PREFERRED EMBODIMENTS

Figure 1:
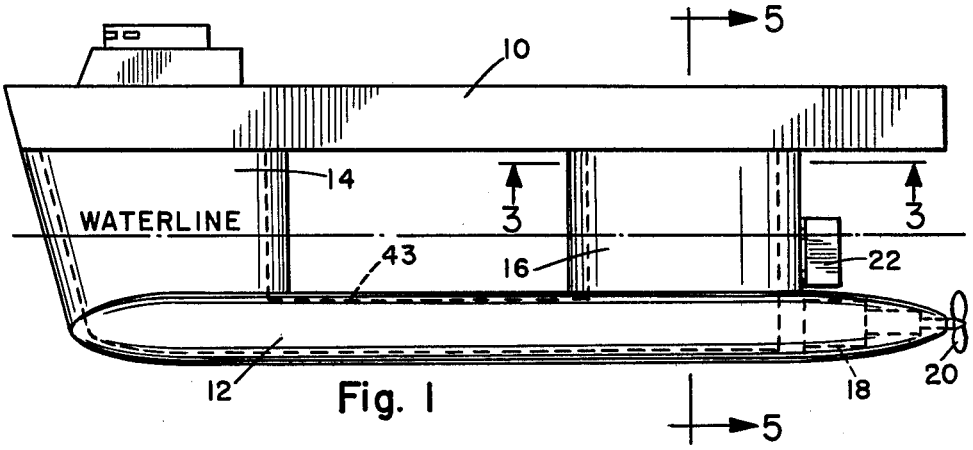
FIG. 1 is a side elevation view of a typical semi-submerged vessel.
Figure 2:
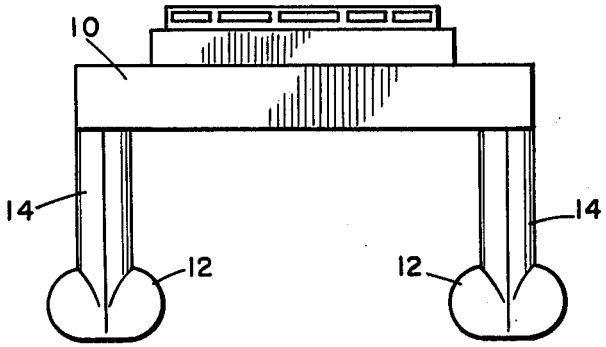
FIG. 2 is a front elevation view of the vessel.

The vessel illustrated in FIGS. 1 and 2 is typical and comprises a superstructure 10, of any suitable configuration, supported on a pair of submerged hulls 12 front struts 14 and rear struts 16. The struts may vary in shape but are streamlined in longitudinal cross section for minimum hydrodynamic drag. Hulls 12 are also suitably streamlined and, as illustrated, each hull has a propulsion unit 18 in the rear end portion, driving a propeller 20. Any other suitable propulsion system may be used, depending on the size and performance requirements of the vessel. Rudders 22 on rear struts 16 provide directional control.

The control system will depend on the particular vessel, various stabilization and control arrangements using vanes on the hulls being disclosed in the above mentioned U.S. patent.

Figure 3:
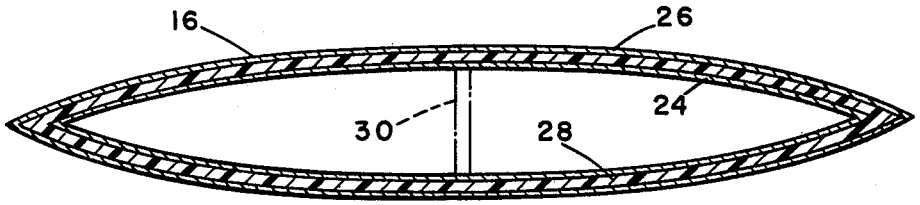
FIG. 3 is an enlarged sectional view taken on line 3—3 of FIG. 1.

A typical strut construction, illustrated in FIG. 3, comprises a hollow shell having an inner wall 24 and a spaced outer wall 26, the space between the walls being filled by a foam material 28, or the like. The foam material can be bonded to the walls to form a lightweight rigid structure. Walls 24 and 26 may be of metal, reinforced plastic, or other such material and in larger or heavy duty vessels a cross brace 30 may be fixed across the interior if necessary.

Figure 4:
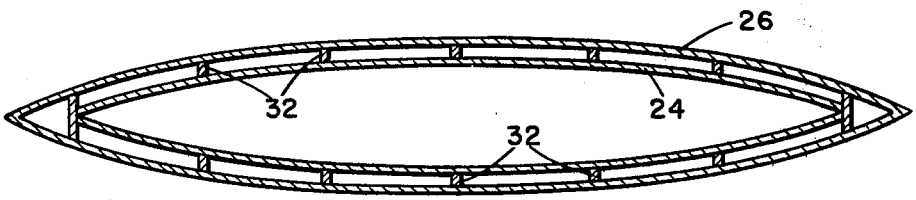
FIG. 4 is a similar sectional view showing an alternative wall structure.

In an alternative structure, shown in FIG. 4, the inner and outer walls 24 and 26 are joined by spaced ribs or stiffeners 32.

Figure 5:
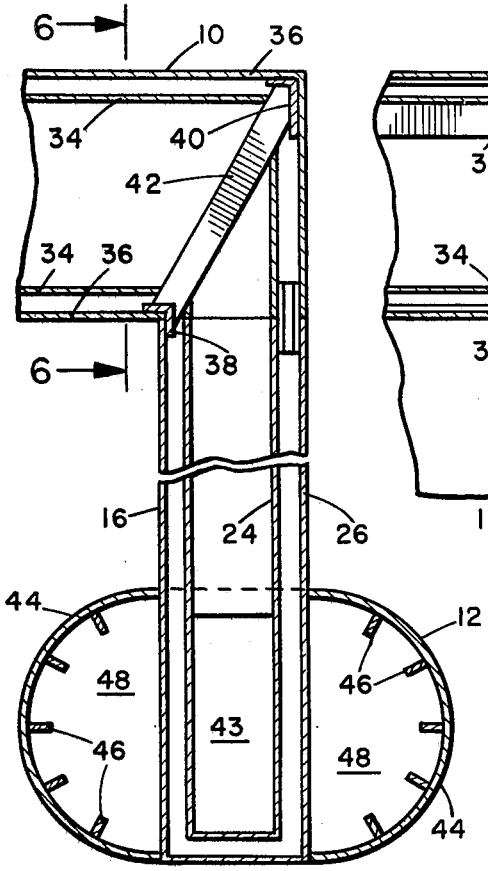
FIG. 5 is an enlarged sectional view taken on line 5—5 of FIG. 1.
Figure 6:
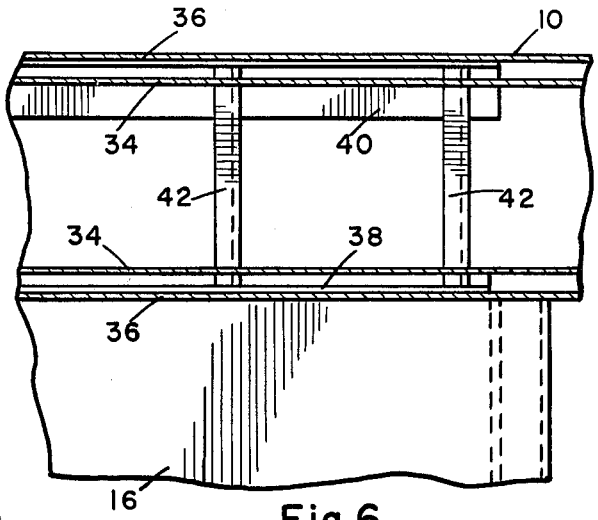
FIG. 6 is a sectional view taken on line 6—6 of FIG. 5.

To obtain a strong joint of the struts to the superstructure with a minimum of internal structure, an arrangement as shown in FIGS. 5 and 6 may be used. Superstructure 10 is shown as having inner walls 34 and outer walls 36, but need not be entirely of this construction. The lower inner corner of the superstructure and strut joint is secured by a reinforcing angle 38 and the upper outer corner of the superstructure has a reinforcing member 40 extending longitudinally. Strength is provided by diagonal braces 42 fixed between angle 38 and member 40. This provides triangulation of the force vectors, so that bending loads on the strut caused by side loads are transformed into compression and tension forces through the diagonal braces into the superstructure. The diagonal braces are spaced longitudinally, as in FIG. 6, to leave sufficient space for passing cargo into and out of the struts. The arrangement is particularly suited to handling of cargo in modular packages or containers, which can be compactly stacked.

Hull 12 is shown as being generally oval in cross section, with the strut extending to the bottom of the hull. This avoids a problematic joint of the hull to the strut and carries the interior cavity of the strut down into the hull. The front and rear struts 14 and 16 are preferably interconnected by a passage 43 through the hull, which is then in the form of semi-cylindrical shells 44 on opposite sides of the strut and passage. The shells 44 are reinforced by suitable internal stringers 46 and provide tank space 48 separate from the struts. This allows the hulls to be used for fuel tanks and buoyancy control without affecting the cargo capacity of the struts and intermediate hull section. It should be noted that a single large strut could be used instead of the separate front and rear struts which would provide large storage spaces almost the length of the vessel.

Figure 7:
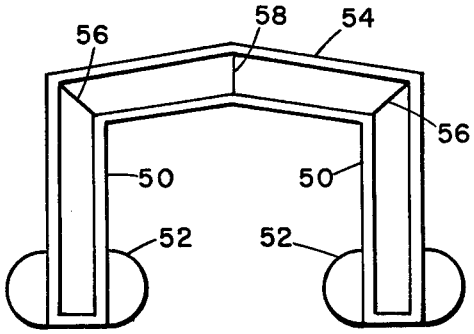
FIG. 7 is a diagrammatic cross-sectional view of one structural configuration of the vessel.

A particular configuration of the vessel is illustrated diagrammatically in cross section in FIG. 7. Struts 50 extending upwardly from hulls 52 are joined to a superstructure 54 and reinforced by diagonal members 56, as in FIG. 5. In this instance, however, the superstructure is of a shallow inverted V-shape, with reinforcing members 58 at the central peak. If required the member 58 could be a full length web dividing the structure into left and right cargo chambers which are continuous from the superstructure through the struts and into the hulls. With a liquid cargo the inclined superstructure portions would provide good drainage into the struts and hulls when loaded from the top.

Figure 8:
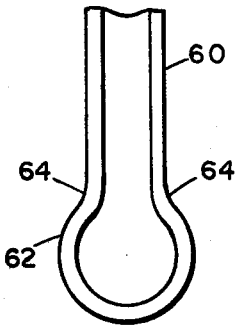
FIGS. 8–10 are diagrammatic cross sections of alternative strut to hull junctions.

In FIG. 8 the double walled strut 60 is blended smoothly into a cylindrical hull 62 by fairings 64. This would be an effective structure where separate hull tanks are not required and the smaller cross section hull is sufficient for buoyancy.

Figure 9:
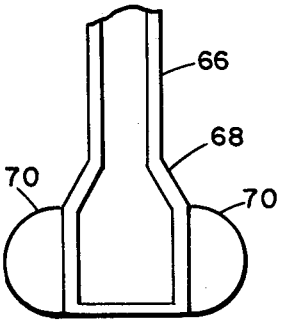
Figure 10:
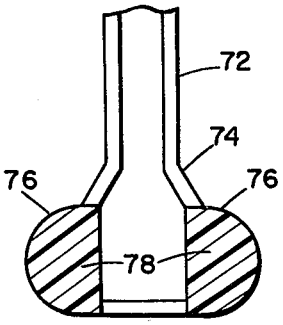

The strut 66 in FIG. 9 has a widened lower portion 68 with hull shell sections 70 on opposite sides. This is similar to the arrangement shown in FIG. 5, but with increased space in the cargo portion of the hull. A similar structure is shown in FIG. 10, with the strut 72 having a widened portion 74, but with the hull shell portions 76 extending into the strut sides and being filled with a foam or insulation material 78. If the spaces between the double walls of the strut are also filled with foam material, this arrangement will provide good thermal insulation of the lower cargo area.

Figure 11:
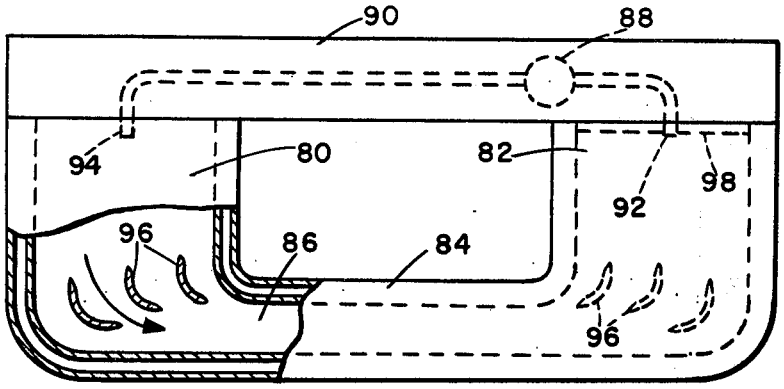
FIG. 11 is a side elevation view, partially cut away, of a vessel with liquid circulation means.

The vessel illustrated in FIG. 11 has double walled struts 80 and 82 which join directly into opposite ends of a hull 84 and are connected by a passage 86 through the hull in a continuous path. This is particularly adaptable to a liquid cargo which must be circulated, such as when carrying live crabs or other such marine creatures which must be kept alive and in good condition for some time. A pump 88 in the superstructure 90 has a pick-up pipe 92 in the strut 82 and a reture pipe 94 opening into the strut 80 to circulate the liquid. At the junction of each strut with the hull are turning vanes 96 to ensure proper circulation. The upper end of strut 82 is closed by a wall 98 to prevent sloshing of the liquid which might occur in a completely open loop.

For maximum efficiency and stability of flow, the cross-sectional area of the path through the struts and hull could be substantially constant. This could be accomplished by making the hull 84 an oval shape and blending the junctions with the struts. The liquid circulation would take place at a reasonably constant speed, with no zones of sudden acceleration and deceleration, thus avoiding unnecessary buffeting of live cargo.

Figure 12:
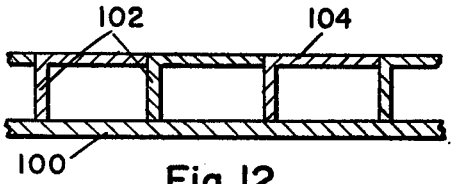
FIGS. 12–15 are detail cross sections of different wall structures.

A double wall structure incorporating integral stiffeners is illustrated in FIG. 12. The outer wall 100 is made from sheet or plate material and is internally reinforced by angle section stiffeners 102, each of which has one leg secured to the outer wall. The stiffeners are spaced so that the other leg of each extends parallel to the outer wall 100 and is joined to the next stiffener to form a collective inner wall 104.

Figure 13:
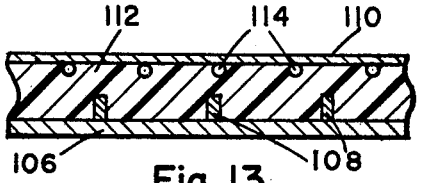

In FIG. 13, the outer wall 106 is reinforced by internal stiffeners 108 and the inner wall 110 is supported on a layer of foam material 112, clear of the stiffeners so there is no direct structural contact between inner and outer walls. This allows the interior cargo space to be cooled or heated by thermal control elements 114 embedded in foam material 112 against the inner wall 110. Most of the structural strength is in the reinforced outer wall, so the inner wall can be relatively thin to serve as a liner for the cargo chamber. For use with corrosive cargo materials, the inner wall 110 can be of stainless steel or the like, or could be coated with a suitable protective material.

Figure 14:
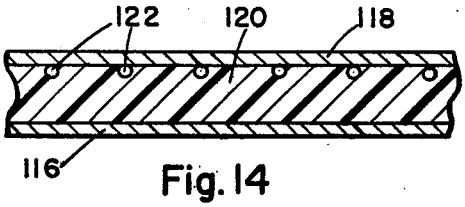

FIG. 14 shows a wall structure in which the outer wall 116 and inner wall 118 are of substantially equal thickness and carry the loads together. The space between the walls is filled with foam material 120 and thermal control elements 122 may be installed against the inner wall if needed.

Figure 15:
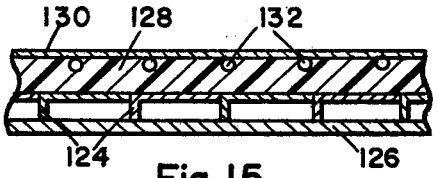

The structure shown in FIG. 15 is basically similar to that of FIG. 12, with interconnected angle section stiffeners 124 secured to the outer wall 126 to form the primary load carrying member. Foam material 128 is applied to the inside surface formed by the stiffeners 124 and a thin inner wall 130 is attached to the foam. The thermal control elements 132 are optional.

The wall structures illustrated are exemplary and various other arrangements may be used, depending on the size and type of vessel and the cargo to be handled.

Figure 16:
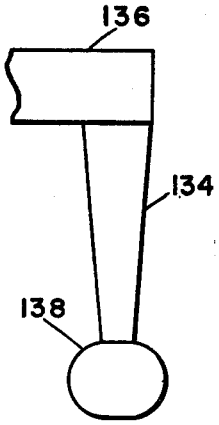
FIGS. 16–18 are front elevation views of alternative tapered strut configurations.

The struts are shown in FIG. 2 as having a constant thickness. For structural and other reasons, however, the struts may be tapered in thickness. FIG. 16, for example, shows a strut 134 which has a straight converging taper downwardly from the superstructure 136 to the hull 138.

Figure 17:
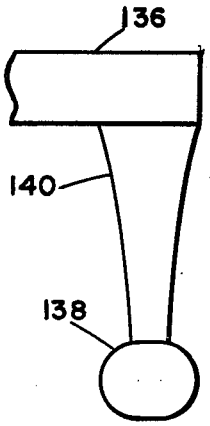
Figure 18:
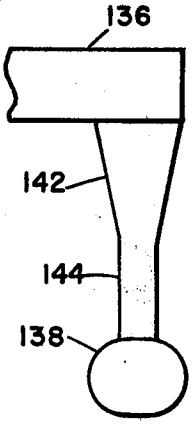

Strut 140 in FIG. 17 has a curved taper, and the strut in FIG. 18 has a tapered upper portion 142 and a straight lower portion 144.

The semi-submerged ship is very stable and capable of high performance and is adaptable to a variety of uses. The characteristics are described in detail in U.S. Pat. No. 3,623,444. By minimizing internal structure and utilizing load bearing walls for the struts and portions of the hulls, the versatility is extended to cargo handling, with a large amount of space being made available in a particular vessel.

Having described my invention, I claim:

1. A semi-submerged ship, comprising:

a superstructure;

a pair of longitudinally extending streamlined submersible hulls;

a plurality of submersible struts each having a lower end connected to and extending upwardly from a corresponding one of the hulls, the struts being streamlined in longitudinal cross section to minimize hydrodynamic drag and including a front strut and a rear strut longitudinally spaced on each hull;

means for defining a vertical cargo passage which extends substantially unobstructed through each strut;

means for defining a horizontal cargo passage which extends substantially unobstructed through each hull, the horizontal cargo passage extending between and connecting the vertical cargo passages in the struts connected to the hull in a continuous path;

first joint means for connecting the lower end of each strut to a corresponding one of the hulls to permit cargo to be moved between the vertical and horizontal cargo passages therein;

second joint means for connecting the upper end of each strut to the superstructure so that the hulls are transversely spaced apart and transverse loads on the struts are resisted without any connecting members extending transversely between the hulls while permitting the passage of cargo through the struts;

at least portions of the struts and hulls having a double walled construction, with load bearing structure contained between the walls to minimize obstruction of the cargo passages; and the hulls and struts having displacement buoyancy such that when the ship is in the water the hulls will be submerged and the superstructure will be above the water.

2. A semi-submerged ship according to claim 1, wherein the struts and interconnecting passages have fluid flow paths therethrough, each of the struts has flow guiding turning vanes therein at the junction of the corresponding vertical and horizontal cargo passages, and pumping means in the superstructure for pumping fluid through the flow paths.

3. A semi-submerged ship according to claim 2, wherein one of the struts has a closed anti-sloshing wall at the upper end thereof, and the pumping means has a pick-up through the wall and a discharge into the other strut.

4. A semi-submerged ship according to claim 2, wherein the fluid flow paths are of substantially constant cross section.

5. A semi-submerged ship according to claim 1, and including hollow portions in the superstructure interconnecting the vertical cargo passages.

6. A semi-submerged ship according to claim 5, wherein the hollow portions of the superstructure are inclined downwardly toward the struts.

7. A semi-submerged ship according to claim 1, wherein the second joint means includes load bearing bracing members interconnecting the struts and the superstructure, the bracing members being spaced longitudinally to permit unobstructed passage of cargo therebetween.

8. A semi-submerged ship according to claim 1, and wherein each hull has hollow shell portions on opposite sides of the horizontal cargo passage and strut to provide tank space separate from the vertical and horizontal cargo passages.

9. A semi-submerged ship, comprising:

a superstructure;

a pair of longitudinally extending streamlined submersible hulls;

at least one pair of submersible struts each having a lower end connected to and extending upwardly from a corresponding one of the hulls, the struts being streamlined in longitudinal cross section to minimize hydrodynamic drag;

means for defining a vertical cargo passage which extends substantially unobstructed through each strut;

means for defining a horizontal cargo passage which extends substantially unobstructed through each hull;

first joint means for connecting the lower end of each strut to a corresponding one of the hulls to permit cargo to be moved between the vertical and horizontal cargo passages therein;

second joint means for connecting the upper end of each strut to the superstructure so that the hulls are transversely spaced apart and transverse loads on the struts are resisted without any connecting members extending transversely between the hulls while permitting the passage of cargo through the struts;

each hull having hollow shell portions on opposite sides of the horizontal cargo passage and strut to provide tank space separate from the vertical and horizontal cargo passages; and the hulls and struts having displacement buoyancy such that when the ship is in the water the hulls will be submerged and the superstructure will be above the water.

10. A semi-submerged ship according to claim 9, wherein the struts comprise a front strut and a rear strut longitudinally spaced on each hull, and the horizontal cargo passage extends between and connects the vertical cargo passages in the struts in a continuous path.

11. A semi-submerged ship according to claim 10, wherein the struts and interconnecting passages have fluid flow paths therethrough, each of the struts has flow guiding turning vanes therein at the junction of the corresponding vertical and horizontal cargo passages, and pumping means in the superstructure for pumping fluid through the flow paths.

12. A semi-submerged ship according to claim 11, wherein one of the struts has a closed anti-sloshing wall at the upper end thereof, and the pumping means has a pick-up through the wall and a discharge into the other strut.

13. A semi-submerged ship according to claim 11, wherein the fluid flow paths are of substantially constant cross section.

14. A semi-submerged ship according to claim 9, and including hollow portions in the superstructure interconnecting the vertical cargo passages.

15. A semi-submerged ship according to claim 14, wherein the hollow portions of the superstructure are inclined downwardly toward the struts.

16. A semi-submerged ship according to claim 9, wherein the second joint means includes load bearing bracing members interconnecting the struts and the superstructure, the bracing members being spaced longitudinally to permit unobstructed passage of cargo therebetween.

17. A semi-submerged ship according to claim 9, wherein at least portions of the struts and hulls are of double walled construction, with load bearing structure contained between the walls to minimize obstruction of the cargo passages.

18. A semi-submerged ship, comprising:

a superstructure;

a pair of longitudinally extending streamlined submersible hulls;

a pair of front and rear submersible struts corresponding to each hull, each strut having a lower end connected to and extending upwardly from its corresponding hull, the struts being streamlined in longitudinal cross section to minimize hydrodynamic drag;

means for defining a vertical cargo passage whigh extends substantially unobstructed through each strut;

means for defining a horizontal cargo passage which extends substantially unobstructed through each hull and connects in a continuous path with the vertical cargo passages in the front and rear struts connected to the hull;

first joint means for connecting the lower end of each strut to a corresponding one of the hulls to permit cargo to be moved between the vertical and horizontal cargo passages therein;

second joint means for connecting the upper end of each strut to the superstructure so that the hulls are transversely spaced apart and transverse loads on the struts are resisted without any connecting members extending transversely between the hulls while permitting the passage of cargo through the struts;

the struts and interconnecting passages having fluid flow paths therethrough, pumping means in the superstructure for pumping fluid through the flow paths, and wherein at least one of the struts of one of the front and rear pairs has a closed anti-sloshing wall at the upper end thereof, and the pumping means has a pick-up through the wall and a discharge into the other strut of the one front and rear pair; and the hulls and struts having displacement buoyancy such that when the ship is in the water the hulls will be submerged and the superstructure will be above the water.

19. A semi-submerged ship according to claim 18, wherein the fluid flow paths are of substantially constant cross section.

20. A semi-submerged ship according to claim 18, and including hollow portions in the superstructure interconnecting the vertical cargo passages.

21. A semi-submerged ship according to claim 20, wherein the hollow portions of the superstructure are inclined downwardly toward the struts.

22. A semi-submerged ship according to claim 18, wherein the second joint means includes load bearing bracing members interconnecting the struts and the superstructure, the bracing members being spaced longitudinally to permit unobstructed passage of cargo therebetween.

23. A semi-submerged ship according to claim 18, wherein at least portions of the struts and hulls are of double walled construction, with load bearing structure contained between the walls to minimize obstruction of the cargo passages.

24. A semi-submerged ship according to claim 18, and wherein each hull has hollow shell portions on opposite sides of the horizontal cargo passage and strut to provide tank space separate from the vertical and horizontal cargo passages.

* * * * *